United States Patent [19]

Uda et al.

[11] 4,266,158

[45] May 5, 1981

[54] CATHODE RAY TUBE SOCKET WITH A SPARK GAP

[75] Inventors: Masayuki Uda, Osaka; Yoshiichi Hayakawa, Higashiosaka, both of Japan

[73] Assignee: Hosiden Electronics Co., Ltd., Osaka, Japan

[21] Appl. No.: 36,704

[22] Filed: May 7, 1979

[30] Foreign Application Priority Data

May 10, 1978 [JP] Japan ..... 53-62219[U]

[51] Int. Cl.[3] ..... H01J 17/00; H01J 21/00

[52] U.S. Cl. ..... 313/325; 313/146; 313/51; 361/129; 339/14 T; 339/143 T

[58] Field of Search ..... 313/146, 147, 148, 51, 313/49, 325; 361/119, 129; 339/14 T, 111 R, 143 T, 192 T

[56] References Cited

U.S. PATENT DOCUMENTS

| | | | |
|---|---|---|---|
| 3,748,521 | 7/1973 | Wright et al. | 313/325 |
| 3,916,238 | 10/1975 | Suzuki | 313/325 |
| 4,119,878 | 10/1978 | Uda | 313/325 |
| 4,156,161 | 5/1979 | Pittman | 313/325 |

*Primary Examiner*—Saxfield Chatmon, Jr.

*Attorney, Agent, or Firm*—Pollock, Vande Sande & Priddy

[57] ABSTRACT

In a cathode ray tube socket, contacts to be respectively connected with terminal pins of a cathode ray tube are housed in a body, which has formed therein a chamber for a pair of electrode holders, the electrode holders being removably and adjustably supported in position within the chamber by cooperating projections and depressions, each electrode holder having fitted therein an electrode plate, and semispherical electrode portions projecting from the electrode plates are disposed adjacent each other to define therebetween a spark gap, one of the electrode plates being electrically connected with a contact for high voltage use.

8 Claims, 7 Drawing Figures

CATHODE RAY TUBE SOCKET WITH A SPARK GAP

BACKGROUND OF THE INVENTION

This invention relates to a cathode ray tube socket having a spark gap which is adapted so that an overvoltage is grounded by discharge generation to achieve a protective operation.

In a cathode ray tube socket, a spark gap for protecting the associated circuits from an overvoltage to a focus electrode of a cathode ray tube is different in size from the spark gaps used to protect the other electrodes. In the conventional cathode ray tube socket set forth, for example, in U.S. Pat. No. 3,865,452, the spark gap for the focus electrode is made peculiar to the socket; therefore, if the lowest value of the overvoltage from which the associated circuits are to be protected is changed, the design of the entire socket must be changed.

An object of this invention is to provide a cathode ray tube socket having a spark gap which can easily be assembled,by changing only a very small number of parts, in accordance with the lowest value of a firing voltage.

Another object of this invention is to provide a cathode ray tube socket having a spark gap which permits easy changing of the lowest value of a firing voltage and which can be produced with uniform characteristics.

Still another object of this invention is to provide a cathode ray tube socket having a spark gap in which the lowest value of a firing voltage can be easily and greatly changed using the same parts.

SUMMARY OF THE INVENTION

According to this invention, a spark gap unit housing chamber is provided in the body of a cathode ray tube socket and, in this chamber, a pair of electrode holders are disposed opposite to each other. Electrode plates are respectively mounted on the electrode holders and dome-shaped electrode portions project respectively from the electrode plates in opposing relation to each other. The electrode holders are each fitted in the chamber on both sides and held therein. Between the holding parts, there are formed depressions and projections for increasing the distance between the dome-shaped electrode portions. By selectively using electrode plates having dome-shaped electrode portions of different sizes and shapes, the protecting characteristic can be altered. Further, by changing the electrode holder retaining position, the protecting characteristic can be greatly changed.

DESCRIPTION OF THE PREFERRED EMBODIMENTS

Figure 1:
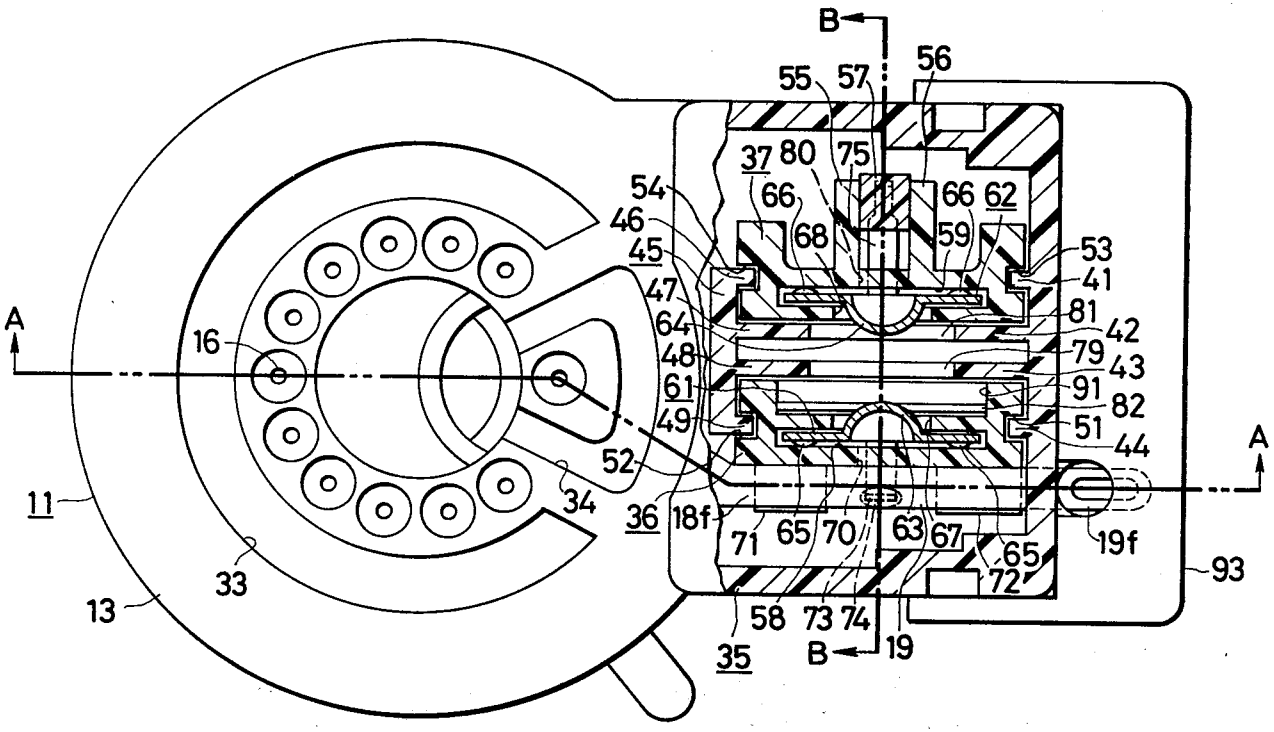
FIG. 1 is a plan view, partly in section, showing an embodiment of a cathode ray tube having a spark gap according to this invention.
Figure 2:
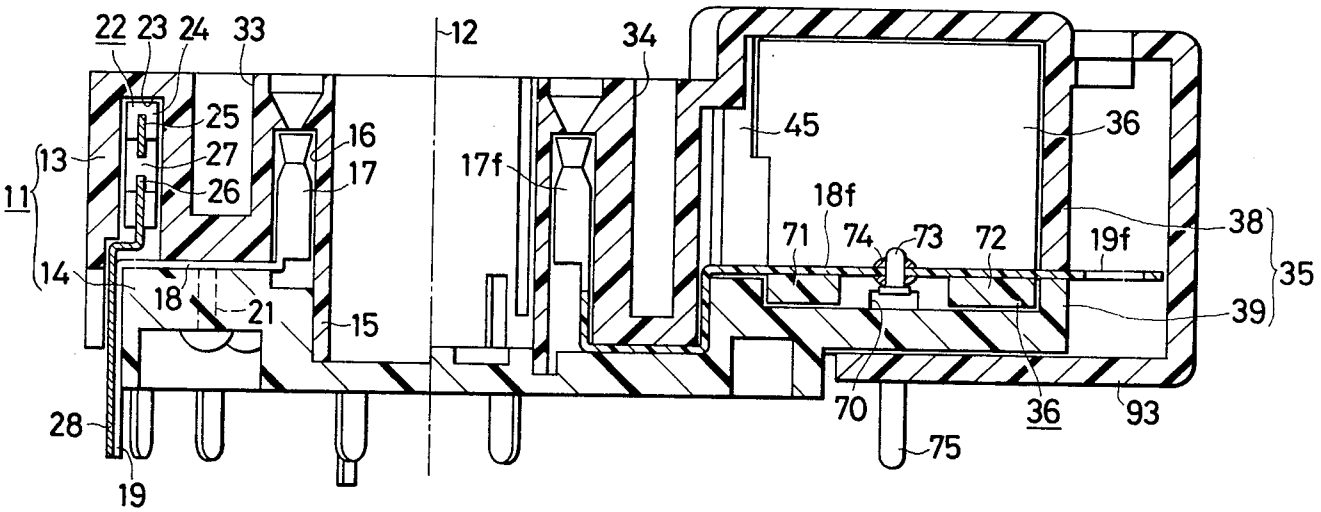
FIG. 2 is a sectional view taken on the line A—A in FIG. 1.
Figure 6:
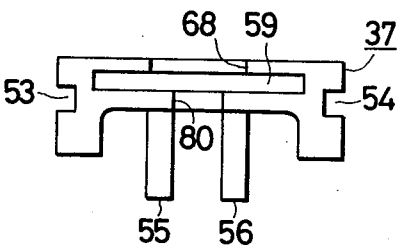
FIG. 6 is a plan view of an electrode holder 37.
Figure 5:
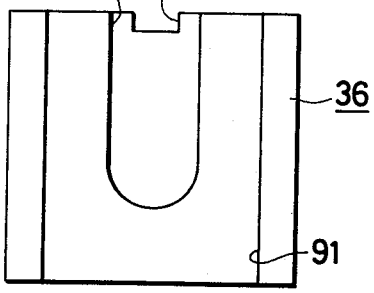
FIG. 5 is a front view of electrode holder 36.
Figure 4:
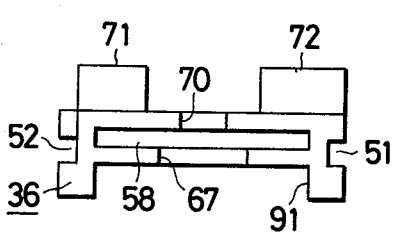
FIG. 4 is a plan view of an electrode holder 36.

Referring first to FIGS. 1 and 2, a disc-like body, for example a substantially cylindrical disc 11 made of an insulating material, comprises front and rear disc members 13 and 14 divided in the axial direction 12 of the disc 11. A hollow cylindrical part 15, formed to extend rearwardly from the inner peripheral surface of an opening of the front disc member 13 in its axial direction, is snugly fitted into a hole of the rear disc member 14. The front disc member 13 has formed therein a plurality of contact housing parts 16 outside of the cylindrical part 15 at substantially equiangular intervals about the axis 12. These contact housing parts 16 each house a contact 17 for engagement with one of the terminal pins of a cathode ray tube. The contacts 17, except contact 17*f* for the focusing electrode of the cathode ray tube, are each composed of a tubular body and an elongated terminal member 18 formed integrally therewith to extend outwardly in a radial direction with respect to the axis 12. The elongated terminal member 18 is passed between the front and rear disc member 13 and 14 and bent backwardly to extend in a groove formed in the outer peripheral surface of the rear disc member 14 in the axial direction thereof, forming a terminal 19.

On the back of the front disc member 13 there are formed integrally therewith bosses 21, each projecting between adjacent ones of the elongated terminal members 18. The bosses 21 are respectively inserted into corresponding through holes formed in the rear disc member 14 and their projecting ends are expanded and fused by heating to the walls of said through holes whereby the front and rear disc members 13 and 14 are mechanically coupled together. For grounding overvoltages to the contacts 17, protective spark gap defining members 22 are provided respectively corresponding to the contacts 17. For example, in the back surface of the rear disc member 13, there is formed, in opposing relationship to the contacts 17, a circular shaped hole 23 for housing the spark gap defining members 22 on the outside of the circular contact array but concentrically therewith. In the hole 23 is housed electrode support moldings 24, each of which has a frame-like configuration, and a pair of electrodes 25 and 26 project out of each molding 24 to extend inside of its frame, defining a spark gap 27 between the opposing ends of the electrodes 25 and 26. The other end of the one electrode 26 is led out of the molding 24 to form a terminal 28, which is placed on the terminal 19 of a corresponding one of the contacts 17 to achieve electrical connection therewith.

The spark gap defining members 22 can be constructed, for example, in the manner shown in U.S. Pat. No. 4,119,878 issued Oct. 10, 1978 and entitled "Spark Gap Device for a Cathode Ray Tube". Although no detailed description will be given, the spark gap defining members corresponding to the contacts can be formed as a unitary structure. Though not shown, the other electrodes 25 are interconnected through an arm and a ground terminal is connected thereto.

Upon application of an overvoltage exceeding a predetermined value to a given contract 17, a discharge occurs in the spark associated gap 27, by which the overvoltage is grounded from the terminal 28 via the spark gap 27, the electrode 25, the abovesaid arm interconnecting the electrodes 25 and the abovementioned ground terminal. Between the circular arrays of the contacts 17 and the spark gap defining members 22 an annular groove 33 is formed in the front surface of the front disc member 13. Further, a groove 34 is formed in the front surface of the front disc member 13 to surround the contact 17*f* for the focusing electrode of the cathode ray tube. The ends of groove 34 communicate with the opening of the front disc member 13.

Figure 3:
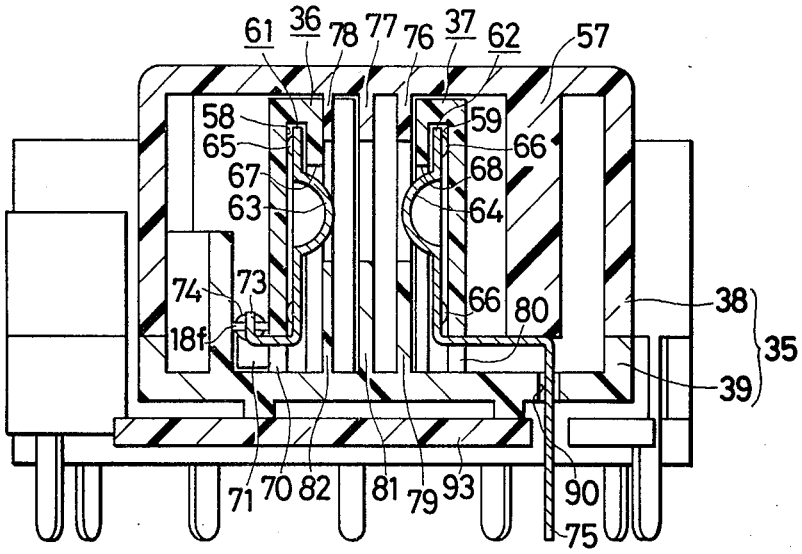
FIG. 3 is a sectional view taken on the line B—B in FIG. 1.

Referring to FIGS. 1 to 6, on the opposite side from the axis 12 with respect to the contact 17*f* a spark gap unit chamber 35 is formed as a unitary structure with the disc 11. A pair of opposing electrode holders 36 and 37, each made of an insulating material, are disposed in the spark gap unit chamber 35 as shown in FIGS. 1 and 3. The chamber 35 is defined by a rectangular body 38 which is formed integrally with the front disc member 13 and open to the rear disc member 14, the open end being covered by an extension 39 of the rear disc member 14.

On both sides of each of the electrode holders 36 and 37 and on the inner wall of the chamber 35 at corresponding positions, there are formed engaging means, by which the electrode holders 36 and 37 are held in the chamber 35. For instance, on the inner surface of the side wall of the chamber body 38, on the side opposite from the contact 17*f*, there are formed at relatively short intervals four inwardly projecting ribs 41, 42, 43 and 44 extending in parallel to the axis 12 as shown in FIG. 1. In opposing relation to these ribs, a support plate 45 is mounted on the front panel of the chamber body 38 as a unitary structure therewith on the side of the contact 17*f*. The support plate 45 has ribs 46 to 49 formed integrally therewith to project inwardly in opposing relation to the ribs 41 to 44 respectively. In both side walls of the electrode holder 36 are respectively formed vertical grooves 51 and 52 for receiving the ribs 44 and 49. In a similar manner, vertical grooves 53 and 54 for receiving the ribs 41 and 46 are formed in both side walls of the electrode holder 37. In other words, the straight projections formed on the side walls of the electrode holders 37 and 36 are inserted between the ribs 41 and 42, between 43 and 44, between 46 and 47 and between 48 and 69, respectively. Thus, the electrode holders 36 and 37 are mounted in the chamber 35 in a manner to be removable therefrom in a direction parallel to the axis 12. When mounted in place, the electrode holders 36 and 37 are retained at predetermined positions within chamber 35.

At the central portion on the side of the electrode holder 37 opposite from the electrode holder 36 a pair of opposing but closely spaced guide pieces 55 and 56 are formed integrally with the holder 37. A square pillar 57 is located on the front panel of the chamber body 38 as a unitary structure therewith to extend therefrom backwardly between the guide pieces 55 and 56. In the back surfaces of the electrode holders 36 and 37, there are respectively formed slit-like, deep depressions 58 and 59 extending forwardly (refer to FIG. 3, too). Electrode plates 61 and 62 are respectively fitted into these depressions 58 and 59. The central portions of the electrode plates 63 and 64 project out therefrom, for example, in a semispherical form to provide dome-shaped electrode portions 63 and 64. If necessary, pluralities of lugs 65, 66 (see FIG. 7) are respectively formed to project outwardly from the electrode plates 61 and 62 on the opposite side of the electrode portions 63 and 64, to assure that the electrode plates 61 and 62 are held tightly in the depressions 58 and 59. In order to permit the projection of the electrode portions 63 and 64 and the insertion of the electrode plates 61 and 62 into the depressions 58 and 59, openings 67 and 68 are respectively formed in the opposing surfaces of the electrode holders 36 and 37 to extend from the open ends of the depressions 58 and 59. Since the electrode plates 61 and 62 are pressed into the electrode holders 36 and 37, if electrode plates 61 and 62 of identical construction are used, the lengths of the electrode portions 63 and 64 projecting from the electrode holders 36 and 37 are constant and retained stabley. As a result of this, the distance between the electrode portions 63 and 64 has a predetermined fixed value.

An elongated terminal member 18*f* of the contact 17*f* is led out therefrom obliquely, viewed from the front, and then extended along the electrode holder 36 on the opposite side from the electrode portion 63 to project out of the chamber 36, forming a terminal 19*f* for the focusing electrode of the cathode ray tube. The elongated terminal member 18*f* is extended backwards from the position of the contact 17*f* and passed on the back of the grooved portion 34 of the front disc member 13 and then turned up to extend into the chamber 35 as shown in FIG. 2. When the open end of the chamber body 38 is covered with the extension 39, the terminal 19*f* is held therebetween and urged against rests 71 and 72 formed integrally with the electrode holder 36 so that the terminal 19*f* is firmly retained in position. In the back of the electrode holder 36 a recess 70 is formed in opposing relation to the opening 67 and a lead piece 73 is led out of the central portion of the electrode plate 61 on the side of the extension 39 and extended through the recess 70 to the opposite side from the electrode plate 62 and then bent up between the rests 71 and 72; the bent portion is inserted into a small hole made in the elongated terminal member 18*f* of the contact 17*f* and soldered thereto, as indicated by 74.

Also in the back of the electrode holder 37, a recess 80 is formed in opposing relation to the opening 59 and ground terminal 75 is led out from the central portion of the electrode plate 62 on the side of the extension 39 to the side opposite from the electrode plate 61 and inserted between the guide pieces 55 and 56 to run across the end face of the square pillar 57 and then bent backwards to project out through a small hole 90 made in the extension 39. For the purpose of increasing the distance between the dome-shaped electrode portions 63 and 64 along surfaces of the parts interposed therebetween, depressions and projections are provided in the chamber 35. As these depressions and projections, the ribs 42, 43, 47 and 48 perform their functions and, at the same time, ribs 76 and 77 are formed on the inside of the front panel of the chamber 35 integrally therewith to extend between the end portions of the ribs 42 and 43 and between the end portions of the ribs 47 and 48, respectively. Further, a rib 78 is formed integrally with the front panel on the side of the electrode plate 61 in a manner to make contact with the electrode holder 36. In other words, there is formed in the electrode holder 36 on the side of the electrode holder 37 a wide depression 91 which extends to the front and rear edges of the electrode holder 36, and the rib 78 is disposed close to the bottom of the depression 91. On the inside of the extension 39 of the chamber 35 are formed integrally therewith projecting pieces 79, 81 and 82 in opposing relation to the ribs 76, 77 and 78 respectively. On the side of the terminal 19*f* for focusing use, projecting out of the chamber 35, a cover 93 for isolating the terminal 19*f* from the outside is attached to the chamber 35.

In the cathode ray tube socket of this invention described above, when an overvoltage is applied to the contact 17*f* for focusing use, a discharge is produced between the dome-shaped electrode portions 63 and 64 to ground the overvoltage via the terminal 75. The protecting characteristic, that is the lowest voltage which yields a discharge between the electrode portions 63 and 64, can be changed by mounting, on the electrode holders 36 and 37, electrode portions 63 and 64 whose sizes and shapes are selected corresponding to a desired characteristic. In other words, in the assembling of this cathode ray tube socket, electrode portions 63 and 64 of the desired characteristic are fitted into the electrode holders 36 and 37 and then the holders 36 and 37 are inserted into the chamber 35; therefore, the protecting characteristic can be easily changed by replacement of only the electrode plates 61 and 62, and the other parts can be used as they are. The sizes of the dome-shaped electrode portions 63 and 64 can easily be altered by adjusting the stroke distance during the press working operation used to fabricate the electrodes. Where the projections of the electrode portions 63 and 64 are long, the lowest voltage which produces a discharge between the electrode portions 63 and 64 is lowered.

The chamber body 38, the extension 39 and the electrode holders 36 and 37 can be mass-produced as moldings of a synthetic resinous material with high precision at low cost and, likewise, the electrode plates 61 and 62 can be made with appreciably high precision by means of press working. Accordingly, by pressing the electrode plates 61 and 62 into the electrode holders 36 and 37 and, in turn, shaping and sizing the electrode portions 63 and 64 so that they are spaced a predetermined distance apart when mounted in the electrode holders, mass production of cathode ray tube sockets of uniform discharge characteristic can be achieved.

By giving the electrode portions 63 and 64 a semispherical form, it is possible to prevent the influence of flash resulting from press working from being exerted on the discharge characteristic; therefore, no secondary working is needed for trimming. It is possible to use a material of excellent insulating resistance and heat resistance for the electrode holders 36 and 37 only and an inexpensive material for the chamber 35. When the electrode plate 61 is mounted on the electrode holder 36 and the elongated terminal member 18*f* of the contact for focusing use is disposed along the electrode holder 36 across the rests 71 and 72, with the lead piece 73 of the electrode plate 61 and the elongated terminal member 18*f* being soldered together, the elongated terminal member 18*f* is positioned and held on the rests 71 and 72 so that the soldering is easy to perform.

Figure 7:
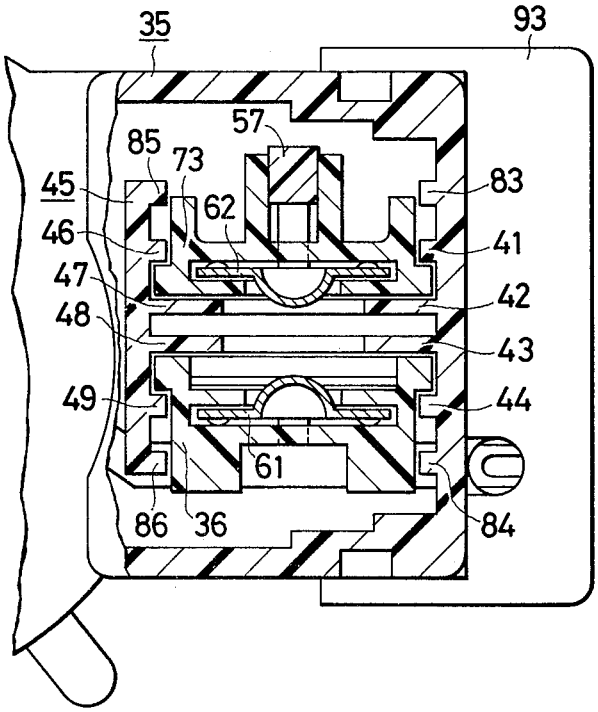
FIG. 7 is a sectional view showing the principal part of another embodiment of this invention.

As shown in FIG. 7, ribs 83, 84, 85 and 86 are formed in the chamber 35 outside of the ribs 41 and 42 and the ribs 46 and 49 at the same intervals as those between the ribs 41 and 42, between 43 and 44, between 46 and 47 and between 48 and 49 and the electrode holders 36 and 37 are selectively held between such ribs. This arrangement permits the distance between the electrode portions 63 and 64 to be greatly changed. That is, there are three possible mounting positions for the electrode holders 36 and 37, i.e. they can be respectively held between the ribs 43 and 44 and between 41 and 83 or the electrode holders 36 and 37 can be respectively held between the ribs 44 and 84 and between 41 and 83, or they can be mounted as shown in the drawings. Thus the overvoltage protecting characteristic can be greatly changed.

For increasing the distance between the electrode plates 61 and 62 along surfaces of parts interposed therebetween, depressions and projections are provided between the electrode plates 61 and 62, that is, ribs 42, 43, 47, 48, 76 to 79, 81 and 82, ensuring that the electrode plates 61 and 62 are insulated enough to eliminate the possibility of malfunction. In this case, the depressions and projections and the electrode holder retaining means can be partly used in common.

It will be apparent that many modifications and variations may be effected without departing from the scope of novel concepts of this invention.

What is claimed is:

1. A cathode ray tube socket with a spark gap, comprising:

a disc-like body made of an insulating material;

a plurality of contacts supported by said disc-like body for connection with terminal pins of a cathode ray tube;

a spark gap chamber formed integrally with said disc-like body;

a pair of electrode holders made of an insulating material and housed in said chamber in opposing relationship to one another;

means defining a plurality of depressions and projections on both sides of said electrode holders in slidable engagement with one another for removably supporting said electrode holders in said opposing relation to one another within said chamber; and a pair of opposing electrode plates respectively fitted into slit-like depressions formed in said pair of electrode holders, one of said electrode plates being electrically connected to a high-voltage one of said contacts;

said electrode plates including a pair of dome-shaped electrode portions which are respectively formed integrally with said electrode plates, said pair of dome-shaped electrode portions projecting outwardly of the planes of their respective electrode plates and towards each other through openings which are respectively formed in said electrode holders in communication with said slit-like depressions, thereby to define a spark gap in said chamber between said dome-shaped electrode portions.

2. A cathode ray tube socket according to claim 1, wherein said plurality of depressions and projections are adapted to support said pair of electrode holders at any selected one of a plurality of different relative positions thereby to permit the distance between said dome-shaped electrode portions to be selectively varied by varying the support positions of said electrode holders relative to one another in said chamber.

3. A cathode ray tube socket according to claim 1, wherein said plurality of depressions and projections comprise grooves formed on both sides of the electrode holders and a plurality of ribs extending from the inside of said chamber for insertion into said grooves.

4. A cathode ray tube socket according to claim 3, wherein said chamber is composed of two chamber bodies divided from one another in the direction of axis of the disc-like body, and an extension of said disc-like body which covers an open end of said chamber, said ribs being disposed in said chamber substantially in parallel to the axis of said disc-like body.

5. A cathode ray tube socket according to claim 3, wherein each of the slit-like depressions in said electrode holders extends in a direction substantially parallel to said ribs.

6. A cathode ray tube socket according to claim 1, wherein one of said electrode holders has integrally formed thereon a pair of rests, said high-voltage one of said contacts including an elongated terminal member which is disposed across said rests, and a lead element extending from the electrode plate in said one electrode holder and connected with said elongated terminal member between said rests.

7. A cathode ray tube socket according to claim 1, wherein each of said electrode plates has integrally formed thereon a plurality of lugs on the side of said plate opposite to said dome-shaped electrode portion to assist in retaining said electrode plate in its associated slit-like depression.

8. A cathode ray tube socket according to claim 2 wherein said plurality of depressions and projections include projections respectively formed on both sides of each of the electrode holders, and at least three ribs disposed on the inside of the chamber in opposing relation to both sides of said electrode holders, said projections from said electrode holders being shaped to be respectively inserted between adjacent ones of said ribs.

* * * * *